United States Patent [19]

Rassey

[11] Patent Number: 4,469,070

[45] Date of Patent: Sep. 4, 1984

[54] FUEL CONTROL VALVE

[76] Inventor: Louis J. Rassey, 29048 Gloede, Warren, Mich. 48093

[21] Appl. No.: 129,604

[22] Filed: Mar. 12, 1980

[51] Int. Cl.[3] ..... F02M 39/00; F02M 37/20

[52] U.S. Cl. ..... 123/462; 123/459; 261/41 B

[58] Field of Search ..... 123/505, 510, 511, 452, 123/453, 454, 457, 459, 460, 461, 462, 463; 261/44 A, 41 B, 446, DIG. 74

[56] References Cited

U.S. PATENT DOCUMENTS

| | | | |
|---|---|---|---|
| 2,813,522 | 11/1957 | White | 123/462 |
| 2,902,016 | 9/1959 | Powell | 123/462 |
| 2,991,055 | 7/1961 | Powell | 123/459 |
| 3,463,129 | 8/1969 | Babitzka | 123/32 |
| 3,473,523 | 10/1969 | Hilborn | 123/139 |
| 3,800,770 | 4/1974 | Baribeau | 123/459 |
| 3,994,273 | 11/1976 | Stumpp | 123/139 |
| 4,167,921 | 9/1979 | Steinwart | 123/452 |
| 4,190,032 | 2/1980 | Wright | 261/44 A |
| 4,257,379 | 3/1981 | Hickling | 261/44 A |
| 4,292,257 | 9/1981 | Knowlton | 261/41 B |

*Primary Examiner*—Charles J. Myhre

*Assistant Examiner*—Carl Stuart Miller

*Attorney, Agent, or Firm*—Gifford, VanOphem, Sheridan, Sprinkle and Nabozny

[57] ABSTRACT

A fuel control valve for limiting the flow of fuel to an internal combustion engine having fuel injector means. A fuel control valve has a series of orifices in a fuel control block and a cam located in the block and communicating with a fuel pump for an internal combustion engine. The cam is rotatably movable in the control block so as to increase and decrease the cross-sectional flow area for the fuel to the engine by communicating with one or more fuel orifices or jets in the fuel control block. The cam is mechanically connected to the accelerator of the engine so that fuel supply to the stacks leading to the cylinders of the engine is directly controlled according to the operation of the accelerator pedal. In this way, the fuel flow and pressure to the fuel injector is immediately limited when the operator releases the accelerator. This prevents loss of fuel and leakage of fuel after the engine is shut off since the flow area cross section can be decreased to essentially completely block the flow of fuel to the fuel injector, thereby preventing any drip into the combustion chamber.

8 Claims, 8 Drawing Figures

FUEL CONTROL VALVE

BACKGROUND OF THE INVENTION

I. Field of the Invention

This invention relates to a fuel injection system and fuel flow control devices in general. This invention relates more specifically to devices for mechanically controlling fuel flow to injectors.

II. Description of the Prior Art

Various types and arrangements of fuel control devices for fuel injection engines have been shown in the prior art. Most of these devices are more complicated and more expensive to manufacture than the present invention. In many of the devices, a separate accelerator pump is needed to increase the fuel supply indirectly by increasing the rpm of the accelerator pump according to the accelerator pedal. This pump represents an added expense and suffers from many of the same problems of the devices discussed below.

Recently, various types of electrical controls have been provided for regulating the flow of fuel according to various factors such as engine rpm, manifold pressure, and other engine variables. These electrical controls represent an additional expense and suffer from various defects discussed below.

Fuel injectors of various designs have been provided for use in engines, especially racing engines. These various designs have included the air gap type such as is disclosed in Hilborn, U.S. Pat. No. 3,473,523. These injectors rely upon the air pressure in the manifold for operation of the injector to draw fuel into the combustion chambers. Other types have been used, especially in racing engines, wherein the supply of fuel to the combustion chamber through the injector is dependent upon either the manifold pressure, the fuel line pressure to the injector, or both. Many of these designs have included a spring-loaded valve. Various problems have resulted from all of these types of fuel injectors with the conventional fuel supply systems known in the prior art.

One particular problem is the waste of fuel after the engine has been shut off. The injectors tend to slowly drip fuel into the combustion chambers after the engine has been shut off since a certain amount of pressure remains in the fuel line supplying fuel to the injectors. The dripping fuel sometimes causes flooding of the engine when the engine is started again. In any case, fuel drip constitutes a waste of fuel which is to be avoided.

All of the fuel supply systems of the prior art, although giving good controlled progressive increase of fuel input to the combustion chambers, provide little or no capability for controlled progressive decrease in fuel input to the engine for the operator of the vehicle or other device using the engine. This lack of control for reducing the fuel input always results in a waste of fuel and presents another factor which the operator of the engine must control upon deceleration of the engine. This has been especially critical in racing engines where it is desired to immediately reduce the fuel supply to an engine while using a minimum of braking for the vehicle. The conventional fuel supply system for a fuel-injected engine cuts off only the air to the engine when the accelerator pedal is released. The fuel, however, is still under pressure and at least momentarily supplies excess fuel to the engine thereby requiring the operator of a vehicle using a fuel-injected engine to use other measures to control the deceleration of the engine and vehicle. Furthermore, in endurance races, a waste of fuel may require an additional refueling stop which in turn wastes precious time.

Since the accelerator pedal of vehicles using a fuel-injected engine is commonly connected to the throttle valves in the air stacks above the combustion cylinders by a mechanical throttle linkage, the air supply to an engine can be immediately cut off. However, since the fuel supply is not accordingly reduced, a rich mixture results. This results in a waste of fuel, poor combustion, and a high output of hydro-carbons in the exhaust, resulting in increased pollution.

Many other problems have been found with the devices of the prior art, especially problems related to deceleration of the engine and reduction of fuel supply upon deceleration. For example, the low pressure remaining in the manifold above the combustion cylinders, even after the accelerator pedal has been released, causes additional fuel to be sucked into the fuel injector (especially the air-gap type) thereby causing the resulting problems discussed above.

SUMMARY OF THE INVENTION

Applicant's invention is intended to overcome the problems of the prior art, including problems with deceleration of engines, especially racing engines, by providing a fuel regulating device for a fuel injected internal combustion engine. The control for the fuel regulating device is mechanically connected t the accelerator or throttle of the engine. Since the throttle valves in the air stacks above the combustion chambers are also mechanically connected to the accelerator pedal, both the fuel and air supplies are appropriately tapered upon deceleration of the engine when the fuel control device of the present invention is used.

A fuel control block is positioned in the fuel line to the engine and has a mechanism for variably controlling the supply of fuel incrementally or continuously, depending upon the design of the fuel flow passage in the fuel control block of the present invention.

The fuel pump of the engine draws fuel from the fuel tank and supplies it under pressure to the input opening of the fuel block of the present invention, and the accelerator means is used to vary the cross-sectional flow area through the fuel control block to thereby regulate the amount of fuel flowing to the engine.

In the preferred form of the invention, the fuel control device includes a fuel control block having an inlet and outlet port and a cam assembly which is positioned in the control block. The cam assembly is preferably cylindrical and has a protruding pin portion which is mechanically connected to the accelerator of the engine. The cylindrical cam is connected to the pressurized source of fuel and is movable in the inlet of the fuel control block. Rotation of the cam increases the cross-sectional flow passage of the fuel line to the engine by exposing a series of jets or orifices in the fuel control block, which jets or orifices connect the inlet and outlet of the fuel control block. The orifices are exposed to a passage through the fuel cam which connects the jets, through the cam, to the source of pressurized fuel.

It is, therefore, an object of the present invention to provide positive fuel control for fuel injected engines.

It is also an object of the present invention to provide a variable cross-section flow passage in the fuel supply of a fuel injected engine, especially a racing engine.

It is also an object of the present invention to provide a mechanical linkage between the accelerator for an engine and the fuel supply to the engine.

It is also an object of the present invention to simultaneously and instantaneously regulate both the air and fuel supplies to a fuel injected engine.

It is also an object of the present invention to eliminate fuel loss in pressurized fuel injection systems and to eliminate injector drip.

It is a further object of the present invention to provide a standard fuel control block for use in various engines, including racing engines.

It is also an object of the present invention to provide a movable control cam/nozzle to control the flow of fuel from a pressurized fuel supply to a fuel injected engine.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DESCRIPTION OF THE PREFERRED EMBODIMENT

Figure 1:
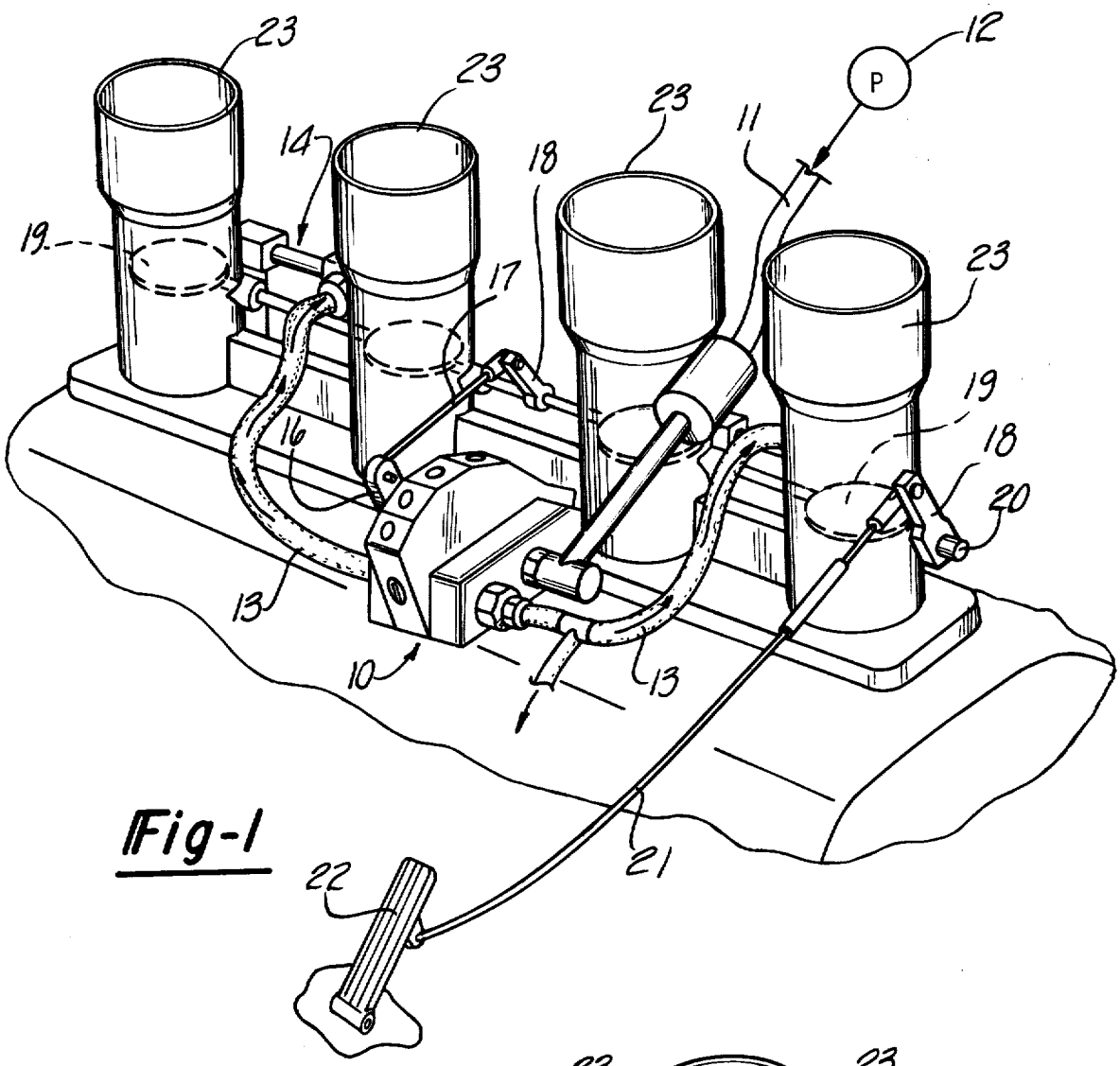
FIG. 1 is a side elevational view of an internal combustion engine which embodies the improved fuel injection system.

The present invention is shown in FIG. 1 as provided in a fuel injected racing engine. Fuel from a vehicle storage tank, for example, is provided to the line 11 under pressure from a fuel pump designated schematically as 12. The fuel flows through the fuel control block 10 and, in the embodiment of FIG. 1, flows out through two separate outlets to hoses 13. The fuel flows under pressure from the fuel control block 10 to the hoses 13 and to inlet line assembly 14 (also shown in FIG. 2) which provide the fuel under pressure to the injectors 15 (also shown in FIG. 3).

The fuel control block 10 is mechanically linked to the accelerator pedal by means of bracket 16, arm 17, and connecting pin 18. All of the throttle valves 19 (shown in phantom) and the connecting pins 18 are connected to a throttle rod 20 which is connected by cable 21 to the accelerator 22. Depression of the accelerator pedal 22 rotates connecting pin 18 at the end of the throttle rod 20 to thereby simultaneously rotate somewhat the throttle valves 19 in stacks 23 and also to move the linkage 16-17-18 so as to rotate the cam 24 (FIGS. 5 and 6) in the fuel control block 10, thereby regulating the flow of fuel from the pressurized source of fuel supply to the fuel injectors 15. In this manner, a direct mechanical connection is provided between the accelerator pedal and the fuel supply to the injectors.

Figure 2:
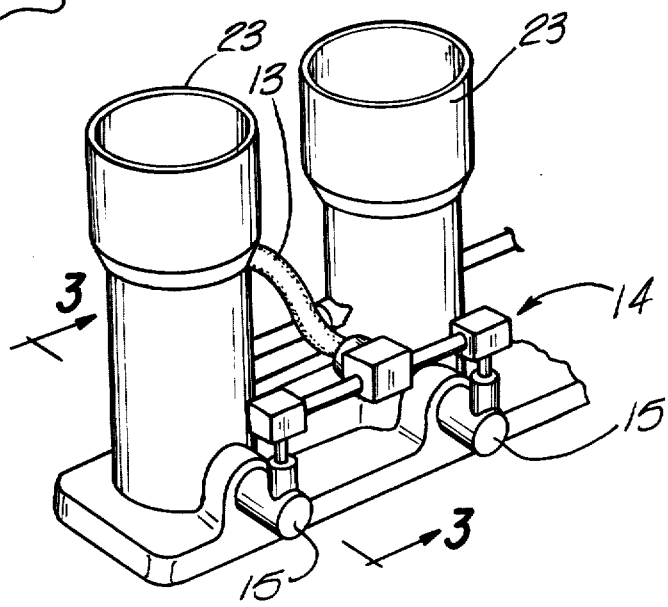
FIG. 2 is a rear view of a portion of the internal combustion engine showing the fuel supply to the injectors.
Figure 3:
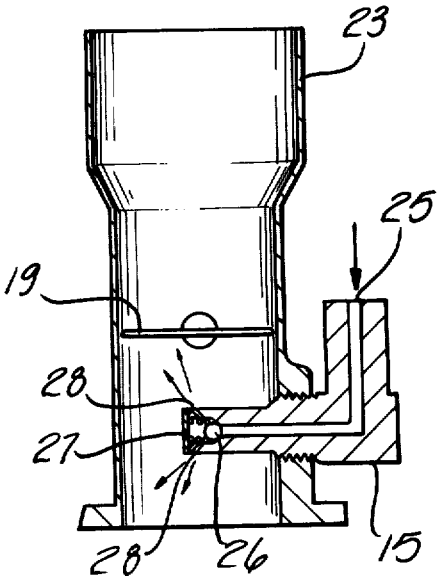
FIG. 3 is a cross section through an air stack and fuel injector of the internal combustion engine, showing the throttle valve in the closed position.

Referring now to FIGS. 2 and 3, the air stacks 23 shown in FIG. 2 are located above combustion cylinders (not shown). The cylinders receive air under pressure from the stacks 23 and fuel under pressure from the injectors 15. The fuel is provided to the injectors 15 through inlet line assembly 14 from hose 13. As can be seen in FIG. 3, the fuel enters the air stack 23 above the cylinder but below the throttle valve 19.

The injector 15 has a fuel inlet line 25. A spring biased ball element 26 is provided at the opposite end of inlet line 25 and is biased in position against inlet 25 by spring 27. When sufficient fuel pressure is applied through inlet 25 against the ball element 26, spring 27 is deflected to allow fuel flow from inlet line 25 to the injector opening 28. The fuel is then charged into the cylinder with the incoming air due to the differential pressure in the cylinder below the air stack 23.

Any of the various types of cylinder means known and used in engines may be used with the fuel control device of the present invention. Furthermore, any type of throttle valve means known and used, especially those used in racing engines, are suitable for use with the present invention. Also, although a typical accelerator pedal 22 has been shown and described in conjunction with the present invention, any other various accelerator control devices or accelerator means are suitable for use with the present invention.

Figure 4:
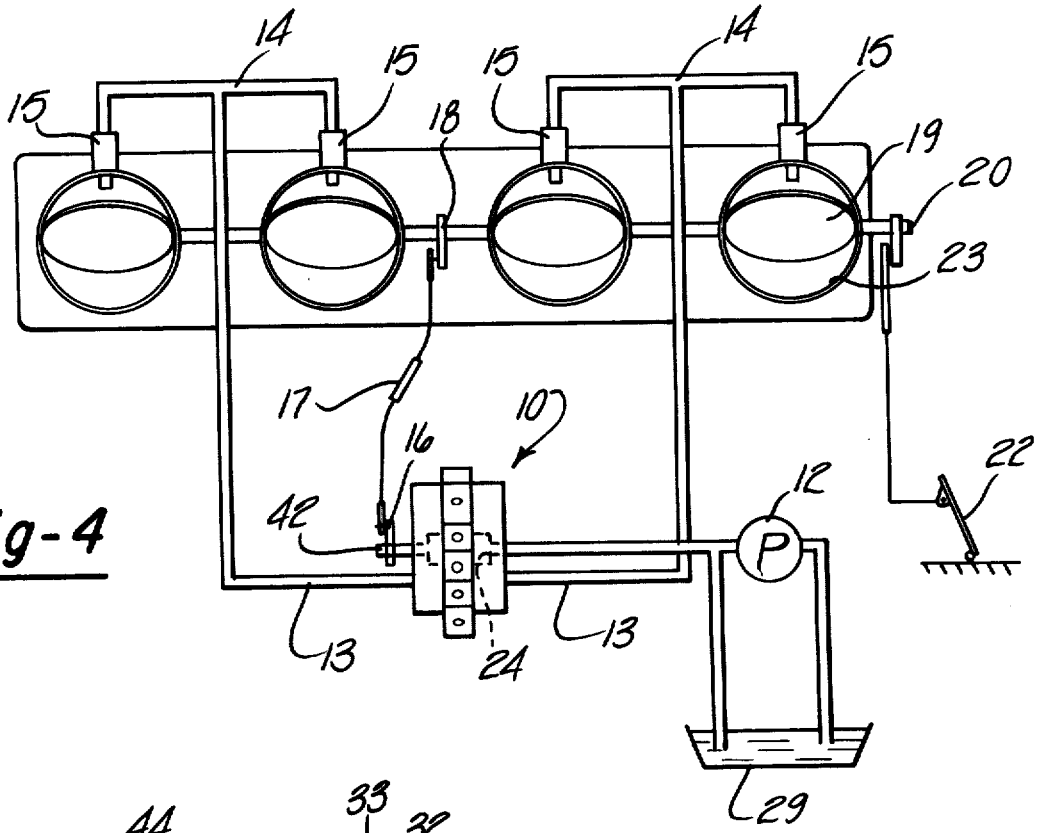
FIG. 4 is a schematic view of an internal combustion engine using the fuel control device of the present invention and connected to a source of pressurized fuel.

FIG. 4 shows a schematic illustration of the fuel control device connected to a pressurized source of fuel from the tank 29 of a vehicle, for example. The fuel is pumped through fuel pump 12 to the fuel control block 10, and is pumped out two outlets, in the embodiment shown, to lines 13 and thereafter to inlet line assemblies 14 so as to supply injectors 15. The throttle valve 19 of the air stacks 23 is shown in the schematic of FIG. 4 in the partially open position. The fuel control cam 24 is shown in phantom in the fuel control block 10 and is connected at its protruding pin portion 42 to bracket 16, linkage arm 17, and connecting pin 18 on throttle rod 20. The rod 20 is connected in a conventional manner to the accelerator pedal 22.

Figure 5:
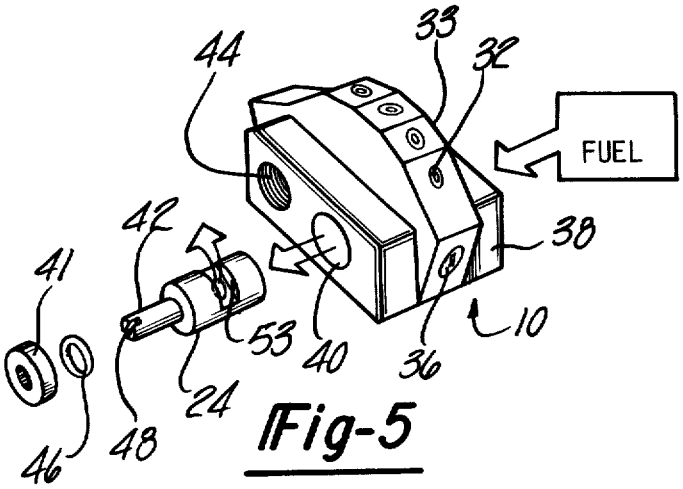
FIG. 5 is an exploded view of the fuel control block and fuel cam of the present invention.

Referring now to FIG. 5, the fuel regulating device/fuel control block 10 of the present invention is thereshown with certain holes formed in the production of this particular embodiment. In this embodiment, five tap holes 32 are drilled through the top portion 33 of the fuel regulating device 10. These larger holes are formed to facilitate formation of the orifices or jets 34 (shown in FIG. 7). The hole 36 is a tap hole drilled so as to provide a fuel flow chamber through the central block portion 38 of the fuel regulating device 10. An inlet or cam chamber 40 is provided on one face of the fuel regulating device 10 and may be tapped completely through the block portion 38 of the device for ease of manufacture. If this is done, then a brass or other insert fitting 41 is provided to receive the protruding pin portion 42 of the cam 24. One or two outlets 44 from the fuel flow passage inside the central block portion 38 are provided for connection to hoses 13 (FIGS. 1 and 4) or their equivalent. An O-ring 46, or equivalent sealing device, is shown for sealing connection of the cam 24 in the inlet 40. A screwdriver slot 48 is provided in the end of the protruding pin portion 42 for mechanical connection to the bracket 16 and arm 17 of the linkage to the accelerator.

The screwdriver slot 48 is located on the end of the protruding pin portion 42 but any equivalent connecting mechanism on the protruding portion of the fuel control cam is suitable for use with the invention so long as mechanical linkage to the throttle and accelerator means may be provided.

Figure 6:
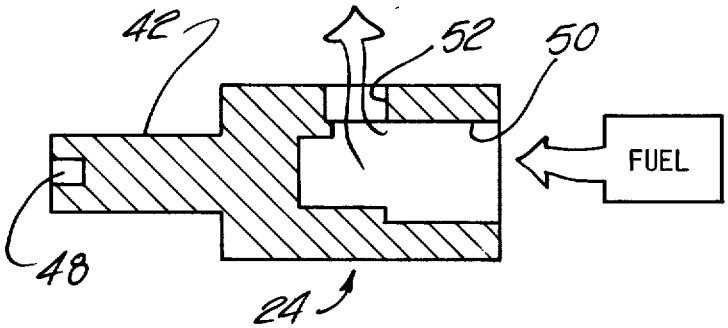
FIG. 6 is a cross section through the fuel control cam of the present invention.

Referring now to FIG. 6, the flow of fuel from the pressurized source of fuel supply is thereshown. Fuel enters an inlet portion 50 of the fuel regulating cam 24 and passes longitudinally into the cam, then transversely out the side of the cam through passage 52. The passage 52 is located in an arcuate cut 53 (FIG. 5) on one side of the cam 24. When positioned in the fuel control block, the cam may be rotated to vary the cross-sectional flow passage for the fuel as will be described in more detail below with reference to FIGS. 7 and 8.

The provision of means for varying the cross-sectional flow passage of fuel from the source of pressurized fuel to the injectors of the engine will now be described with reference to FIGS. 7 and 8. It should be noted that the inlet 40 and the outlets 44 are internally threaded for mating connection of inlet and outlet hoses or their equivalent.

The tap holes 32 in the top portion 33 of the fuel control block 10 are plugged or blocked with tap screws 51 or, alternatively, a blow-off element (not shown). In this manner, the tap holes 32 block any possible flow of fuel from the flow passage 54 through the interior of the fuel control block 10. Similarly, the tap holes 36 are blocked with threaded elements 56 to prevent the leakage or flow of fuel.

The jets or orifices 34 are arranged so that the flow passage for the fuel from the pressurized source through the inlet portion 50 in the control cam (and simultaneously through the inlet 40 of the fuel control device) may be communicated with the passage 52 (FIG. 6) of the control cam. Furthermore, since the control cam is movable in the central block portion 38, the cross-sectional flow passage may be varied from a predetermined minimum to a predetermined maximum. In this manner, the flow of fuel may be successively and cumulatively increased by opening of further communication from the flow of fuel through cam 24 out passage 52 and into orifices or jets 34.

It should be noted at this point that the fuel control device may be so designed that the orifices are not a number of separate passages but are rather a continuously expanding passage which widens the flow passage cross section as the cam is rotated to open a larger cross-sectional flow passage area.

Fuel flows under pressure from the inlet lines through the interior of the control cam 24 out passage 52, and into any exposed orifices 34. Fuel thereafter flows through the internal flow passage 54 to the outlets 44 and thereafter is supplied by the various fuel lines to the injectors above the cylinders.

Figure 7:
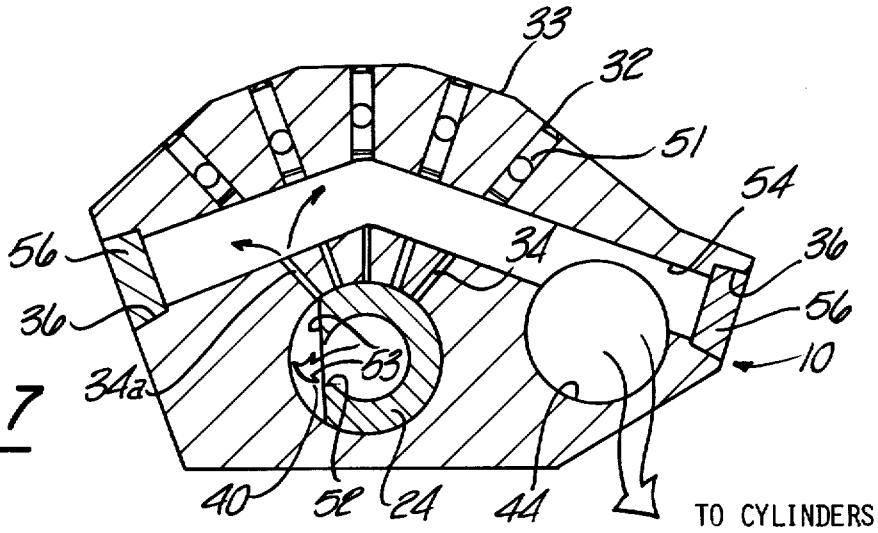
FIG. 7 is a cross section through the fuel control block of the present invention, showing the fuel control block in the idle position.
Figure 8:
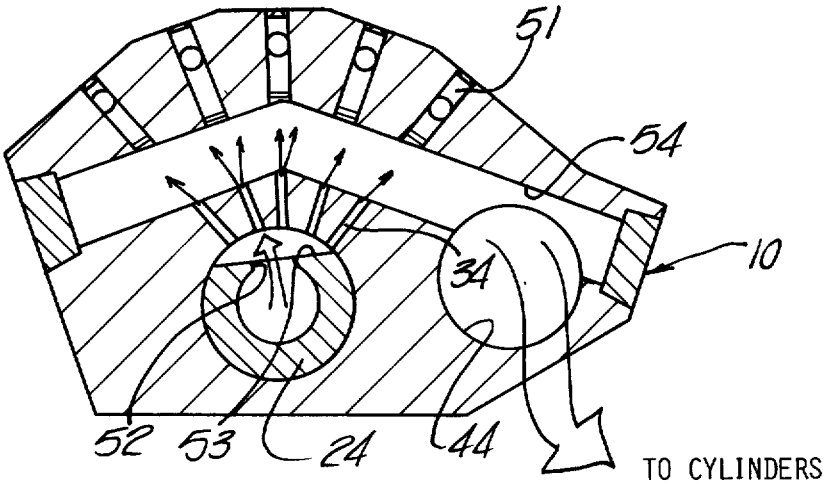
FIG. 8 is a cross section through the fuel control block of the present invention, showing the fuel control block in the full open position.

The fuel control device 10 is shown in FIG. 7 in an idle position; that is, only a small portion of the first orifice 34*a* is exposed to the flow of fuel from the passage 52 and across the arcuate cut portion 53 so as to flow through jet 34*a*. Of course, the cam may be so designed and arranged in the fuel control block 38 that the flow of fuel is completely shut off, that is, none of the orifices 34 are at all exposed to the flow of fuel from the interior flow passage 54 of the control cam 24. In other words, the predetermined minimum flow passage cross section may be designed as zero.

On the other hand, the predetermined maximum cross-sectional flow passage for the fuel control device 10 may be set to a relatively full open position by exposing all of the jets 34 to the flow of fuel out passage 52 along arcuate cut 53 and through the orifices into the internal flow passage 54. From there, the fuel is directed through the fuel lines to the injectors above the cylinders.

Thus, the flow passage 50 of the control cam is successively and cumulatively communicable with a series of fuel orifices 34 in the fuel control block 10. Since the cam 24 is mechanically linked to the accelerator pedal 22, as are the throttle valves 19 in the stacks 23, both the fuel and air supplied to the internal combustion engine may be directly mechanically controlled by the accelerator pedal 22, thereby freeing the supply of fuel to the engine from controls which are dependent upon the rpm of the engine, the manifold pressure, or similar factors which are used by devices of the prior art.

The fuel control device 10 and the fuel cam 24 of the present invention may be produced of any of various metals and similar materials, but stainless steel is especially preferred in high performance engines.

It should also be noted that the fuel control device of the present invention may be cut and the tap holes 32 and 36 may be provided in a special manner on a mass production basis. Thereafter, the orifice means or jets 34 of the invention may be provided in any of various configurations and sizes to suit the needs of the particular engine for which the fuel regulating block 10 is to be used. Furthermore, the shape of the fuel regulating block 10 may be varied considerably, but the preferred embodiment shown is especially useful for ease of manufacture of the particular embodiment.

Operation of a fuel injected engine according to the present invention, will result in a savings of fuel by eliminating pressure drip from the injectors 15 and by directly controlling the flow of fuel upon deceleration of the engine when the operator of the engine lets up on the accelerator pedal 22. Furthermore, a decrease in pollution of hydrocarbons from improper combustion will be realized since the fuel rich mixture now commonly occurring with devices of the prior art, will essentially be eliminated upon deceleration of the engine.

Having described my invention, many modifications thereto will become apparent to those skilled in the art to which it pertains without deviation from the spirit of the invention as defined by the scope of the appended claims.

I claim:

1. A fuel regulating device for a fuel injected internal combustion engine having a movable accelerator, said device comprising:

a fuel control block having a cylindrical chamber and a fuel outlet passageway formed in it, a plurality of orifices formed in said control block, said orifices extending between and interconnecting said fuel outlet passageway and said chamber, said orifices intersecting said chamber at circumferentially spaced positions, a cam rotatably mounted in said chamber, said cam defining a subchamber in said cylindrical chamber between one side of said cam and said control block, said cam being rotatable between a first and second position, wherein the number of orifices fluidly connected with said subchamber increases as said cam moves from said first and toward said second position, means for rotating said cam between said first and second positions in accordance with the position of the movable accelerator, and means for supplying pressurized fuel to said subchamber.

2. The invention as defined in claim 1 wherein said means for supplying fuel comprises a fuel passageway formed axially from one end and to a midpoint of said cam, a radial passageway formed through said cam at said midpoint, a fuel pump and means for fluidly connecting said fuel pump to said end of said cam.

3. The invention as defined in claim 1 and comprising a fuel injector having an injector passage and means for fluidly connecting said fuel outlet passageway to said injector and wherein said injector includes means for permitting fuel flow through the injector passage only when the pressure in the injector passage exceeds a predetermined amount.

4. The invention as defined in claim 3 wherein said last mentioned means comprises a spring loaded one-way valve.

5. The invention as defined in claim 2 wherein said cam is cylindrical in shape having a flat recessed portion formed at said midpoint, said radial passageway extending through said flat portion and said subchamber being formed between said flat portion and the walls of said cylindrical chamber.

6. The invention as defined in claim 2 and comprising means for fluidly sealing said cam to said control block.

7. The invention as defined in claim 1 wherein all of said orifices are fluidly connected to said subchamber when said cam is in said second position.

8. The invention as defined in claim 1 wherein each of said plurality of orifices extend substantially radially from said cylindrical chamber.

* * * * *

UNITED STATES PATENT AND TRADEMARK OFFICE

CERTIFICATE OF CORRECTION

PATENT NO. : 4,469,070
DATED : September 4, 1984
INVENTOR(S) : Louis J. Rassey

It is certified that error appears in the above—identified patent and that said Letters Patent is hereby corrected as shown below:

Column 2, line 29 delete "t" insert --to--.

Column 5, line 60 delete "device" insert --block--.

Signed and Sealed this

*Second* Day of *July 1985*

[SEAL]

*Attest:*

DONALD J. QUIGG

*Attesting Officer* *Acting Commissioner of Patents and Trademarks*